US007674366B2

(12) United States Patent
Strack et al.

(10) Patent No.: US 7,674,366 B2
(45) Date of Patent: Mar. 9, 2010

(54) METHOD FOR PROCESSING HYDROCARBON PYROLYSIS EFFLUENT

(75) Inventors: Robert David Strack, Houston, TX (US); John R. Messinger, Kingwood, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 940 days.

(21) Appl. No.: 11/177,125

(22) Filed: Jul. 8, 2005

(65) Prior Publication Data

US 2007/0007171 A1 Jan. 11, 2007

(51) Int. Cl.
*C10G 9/16* (2006.01)
*C10G 9/18* (2006.01)
*B01J 10/00* (2006.01)

(52) U.S. Cl. ..... 208/48 Q; 208/102; 208/103; 208/106; 422/129

(58) Field of Classification Search ..... 208/46, 208/48 R, 48 Q, 95, 100, 102, 103, 106; 422/129
See application file for complete search history.

(56) References Cited

U.S. PATENT DOCUMENTS

| | | | | |
|---|---|---|---|---|
| 2,343,192 | A | 2/1944 | Kuhn | |
| 2,695,264 | A | 11/1954 | Taff et al. | |
| 2,901,418 | A | 8/1959 | Pappas | |
| 3,060,116 | A | 10/1962 | Hardin, Jr. et al. | |
| 3,498,906 | A * | 3/1970 | Bogart et al. | 208/48 Q |
| 3,907,661 | A | 9/1975 | Gwyn et al. | |
| 3,923,921 | A | 12/1975 | Kohfeldt | |
| 3,959,420 | A | 5/1976 | Geddes et al. | |
| 4,121,908 | A | 10/1978 | Raab et al. | |
| 4,150,716 | A * | 4/1979 | Ozaki et al. | 208/48 Q |
| 4,233,137 | A | 11/1980 | Ozaki et al. | |
| 4,279,733 | A | 7/1981 | Gwyn | |
| 4,279,734 | A * | 7/1981 | Gwyn | 208/48 Q |
| 4,444,697 | A | 4/1984 | Gater et al. | |
| 4,446,003 | A | 5/1984 | Burton et al. | |
| 4,457,364 | A | 7/1984 | DiNicolantonio et al. | |
| 5,092,981 | A | 3/1992 | Russo | |
| 5,107,921 | A | 4/1992 | Tsai | |
| 5,215,649 | A | 6/1993 | Grenoble et al. | |
| 5,294,347 | A | 3/1994 | Byrne et al. | |
| 5,324,486 | A | 6/1994 | Russo | |
| 6,183,626 | B1 | 2/2001 | Lenglet et al. | |
| 6,626,424 | B2 | 9/2003 | Ngan et al. | |

FOREIGN PATENT DOCUMENTS

| | | |
|---|---|---|
| EP | 205 205 | 12/1986 |
| EP | 0 031 609 | 8/2001 |
| GB | 1309309 | 3/1973 |
| GB | 1390382 | 4/1975 |
| JP | 2001-40366 | 2/2001 |
| WO | WO 93/12200 | 6/1993 |
| WO | WO 00/56841 | 9/2000 |

OTHER PUBLICATIONS

Lohr et al., "Steam-cracker Economy Keyed to Quenching," Oil Gas Journal, vol. 76 (No. 20), pp. 63-68, (1978).
Kister, Henry Z., *Distillation Design*, Chapter 6 "*Tray Design and Operation*", pp. 259-363, Chapter 8 "*Packing Design and Operation*", pp. 421-521, McGraw-Hill, Inc., Copyright © 1992.

* cited by examiner

*Primary Examiner*—Glenn Caldarola
*Assistant Examiner*—Randy Boyer

(57) ABSTRACT

A method is disclosed for treating the effluent from a hydrocarbon pyrolysis unit without employing a primary fractionator. The method comprises cooling the gaseous effluent, e.g., by direct quench and/or at least one primary heat exchanger, thereby generating high pressure steam, and then cooling the gaseous effluent to a temperature at which tar, formed by reactions among constituents of the effluent, condenses. The resulting mixed gaseous and liquid effluent is passed through a quench oil knock-out drum, to separate quench oil from the gaseous effluent which is then cooled to condense a liquid effluent comprising pyrolysis gasoline and water condensed from steam, which fractions are separated in a distillate drum. The cooled gaseous effluent is directed to a recovery train, to recover light olefins. The pyrolysis gasoline-containing fraction passes to a tailing tower which provides an overhead stream rich in pyrolysis gasoline and a bottoms stream rich in gas oil.

24 Claims, 1 Drawing Sheet

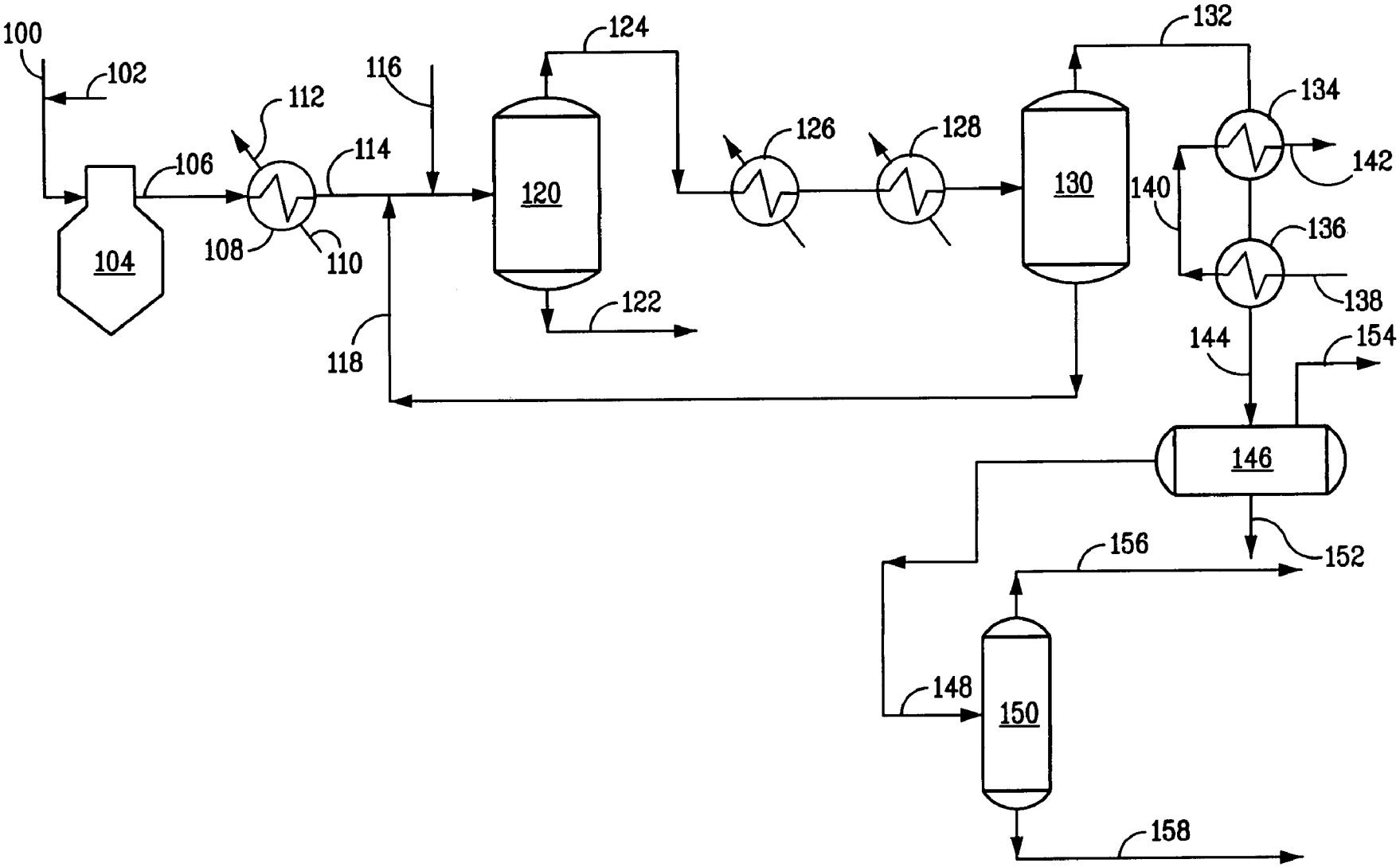
100
102
104
106
108
110
112
114
116
118
120
122
124
126
128
130
132
134
136
138
140
142
144
146
148
150
152
154
156
158

METHOD FOR PROCESSING HYDROCARBON PYROLYSIS EFFLUENT

CROSS-REFERENCE TO RELATED APPLICATIONS

The present application expressly incorporates by reference herein, the entire disclosures of Ser. No. 11/177,975, entitled "Method For Cooling Hydrocarbon Pyrolysis Effluent", Ser. No. 11/178,158, entitled "Method For Processing Hydrocarbon Pyrolysis Effluent", Ser. No. 11/177,075, entitled "Method For Processing Hydrocarbon Pyrolysis Effluent", Ser. No. 11/178,037, entitled "Method For Processing Hydrocarbon Pyrolysis Effluent", and Ser. No. 11/178,025, entitled "Method For Processing Hydrocarbon Pyrolysis Effluent", all of which are incorporated herein by reference and concurrently filed with the present application.

FIELD OF THE INVENTION

The present invention is directed to a method for processing the gaseous effluent from hydrocarbon pyrolysis units, especially those units utilizing feeds that are heavier than naphtha.

BACKGROUND OF THE INVENTION

The production of light olefins (ethylene, propylene and butenes) from various hydrocarbon feedstocks utilizes the technique of pyrolysis, or steam cracking. Pyrolysis involves heating the feedstock sufficiently to cause thermal decomposition of the larger molecules. The pyrolysis process, however, produces molecules which tend to combine to form high molecular weight materials known as tars. Tars are high-boiling point, viscous, reactive materials that can foul equipment under certain conditions.

The formation of tars, after the pyrolysis effluent leaves the steam cracking furnace can be minimized by rapidly reducing the temperature of the effluent exiting the pyrolysis unit to a level at which the tar-forming reactions are greatly slowed.

One technique used to cool pyrolysis unit effluent and remove the resulting heavy oils and tars employs heat exchangers followed by a water quench tower in which the condensibles are removed. This technique has proven effective when cracking light gases, primarily ethane, propane and butane, because crackers that process light feeds, collectively referred to as gas crackers, produce relatively small quantities of tar. As a result, heat exchangers can efficiently recover most of the valuable heat without fouling and the relatively small amount of tar can be separated from the water quench albeit with some difficulty.

This technique is, however, not satisfactory for use with steam crackers that crack naphthas and heavier feedstocks, collectively referred to as liquid crackers, since liquid crackers generate much larger quantities of tar than gas crackers. Heat exchangers can be used to remove some of the heat from liquid cracking, but only down to the temperature at which tar begins to condense. Below this temperature, conventional heat exchangers cannot be used because they would foul rapidly from accumulation and thermal degradation of tar on the heat exchanger surfaces. In addition, when the pyrolysis effluent from these feedstocks is quenched, some of the heavy oils and tars produced have approximately the same density as water and can form stable oil/water emulsions. Moreover, the larger quantity of heavy oils and tars produced by liquid cracking would render water quench operations ineffective, making it difficult to raise steam from the condensed water and to dispose of excess quench water and the heavy oil and tar in an environmentally acceptable manner.

Accordingly, in most commercial liquid crackers, cooling of the effluent from the cracking furnace is normally achieved using a system of transfer line heat exchangers, a primary fractionator, and a water quench tower or indirect condenser. For a typical heavier than naphtha feedstock, the transfer line heat exchangers cool the process stream to about 1100° F. (594° C.), efficiently generating super-high pressure steam which can be used elsewhere in the process. The primary fractionator is normally used to condense and separate the tar from the lighter liquid fraction, known as pyrolysis gasoline, and to recover the heat between about 200° to 600° F. (90° and 316° C.). The water quench tower or indirect condenser further cools the gas stream exiting the primary fractionator to about 100° F. (38° C.) to condense the bulk of the dilution steam present and to separate pyrolysis gasoline from the gaseous olefinic product, which is then sent to a compressor. Sometimes an intermediate boiling range stream known as steam cracked gas oil boiling, say, within the range of about 400° to about 550° F. (200° to 290° C.), is also produced as a sidestream.

The primary fractionator, however, is a very complex piece of equipment that typically includes an oil quench section, a primary fractionator tower and one or more external oil pumparound loops. At the quench section, quench oil is added to cool the effluent stream to about 400° to about 550° F. (200° to 290° C.), thereby condensing tar present in the stream. In the primary fractionator tower, the condensed tar is separated from the remainder of the stream, heat is removed in one or more pumparound zones by circulating oil and a pyrolysis gasoline fraction is separated from heavier material in one or more distillation zones. In the one or more external pumparound loops, oil, which is withdrawn from the primary fractionator, is cooled using indirect heat exchangers and then returned to the primary fractionator or the direct quench point.

The primary fractionator with its associated pumparounds is the most expensive component in the entire cracking system. The primary fractionator tower itself is the largest single piece of equipment in the process, typically being about twenty-five feet in diameter and over a hundred feet high for a medium size liquid cracker. The tower is large because it is in effect fractionating two minor components, tar and pyrolysis gasoline, in the presence of a large volume of low pressure gas. The pumparound loops are likewise large, handling over 1.3 million kilograms per hour (3 million pounds per hour) of circulating oil in the case of a medium size cracker. Heat exchangers in the pumparound circuit are necessarily large because of high flow rates, close temperature approaches needed to recover the heat at useful levels, and allowances for fouling.

In addition, the primary fractionator has a number of other limitations and problems. In particular, heat transfer takes place twice, i.e., from the gas to the pumparound liquid inside the tower and then from the pumparound liquid to the external cooling service. This effectively requires investment in two heat exchange systems, and imposes two temperature approaches (or differentials) on the removal of heat, thereby reducing thermal efficiency.

Moreover, despite the fractionation that takes place between the tar and gasoline streams, both streams often need to be processed further. Sometimes the tar needs to be stripped to remove light components, whereas the gasoline may need to be refractionated to meet its end point specification.

Further, the primary fractionator tower and its pumparounds are prone to fouling. Coke accumulates in the bottom section of the tower and must eventually be removed during plant turnarounds. The pumparound loops are also subject to fouling, requiring removal of coke from filters and periodic cleaning of fouled heat exchangers. Trays and packing in the tower are sometimes subject to fouling, potentially limiting plant production. The system also contains a significant inventory of flammable liquid hydrocarbons, which is not desirable from an inherent safety standpoint.

The present invention seeks to provide a simplified method for treating pyrolysis unit effluent, particularly the effluent from the steam cracking of hydrocarbonaceous feeds that are heavier than naphthas. Heavy feed cracking is often more economically advantageous than naphtha cracking, but in the past it suffered from poor energy efficiency and higher investment requirements. The present invention optimizes recovery of the useful heat energy resulting from heavy feed steam cracking without fouling of the cooling equipment. This invention can also obviate the need for a primary fractionator tower and its ancillary equipment.

There is therefore a need for a simplified method for cooling pyrolysis unit effluent and removing the resulting heavy oils and tars which obviates the need for a primary fractionator tower and its ancillary equipment, even where steam cracked gas oil is produced.

U.S. Pat. Nos. 4,279,733 and 4,279,734 propose cracking methods using a quencher, indirect heat exchanger and fractionator to cool effluent, resulting from steam cracking.

U.S. Pat. Nos. 4,150,716 and 4,233,137 propose a heat recovery apparatus comprising a pre-cooling zone where the effluent resulting from steam cracking is brought into contact with a sprayed quenching oil, a heat recovery zone, and a separating zone.

Lohr et al., "Steam-cracker Economy Keyed to Quenching," Oil & Gas Journal, Vol. 76 (No. 20), pp. 63-68, (1978), proposes a two-stage quenching involving indirect quenching with a transfer line heat exchanger to produce high-pressure steam along with direct quenching with a quench oil to produce medium-pressure steam.

U.S. Pat. Nos. 5,092,981 and 5,324,486 propose a two-stage quench process for effluent resulting from steam cracking furnace comprising a primary transfer line exchanger which functions to rapidly cool furnace effluent and to generate high temperature steam and a secondary transfer line exchanger which functions to cool the furnace effluent to as low a temperature as possible consistent with efficient primary fractionator or quench tower performance and to generate medium to low pressure steam.

U.S. Pat. No. 5,107,921 proposes transfer line exchangers having multiple tube passes of different tube diameters. U.S. Pat. No. 4,457,364 proposes a close-coupled transfer line heat exchanger unit.

U.S. Pat. No. 3,923,921 proposes a naphtha steam cracking process comprising passing effluent through a transfer line exchanger to cool the effluent and thereafter through a quench tower.

WO 93/12200 proposes a method for quenching the gaseous effluent from a hydrocarbon pyrolysis unit by passing the effluent through transfer line exchangers and then quenching the effluent with liquid water so that the effluent is cooled to a temperature in the range of 220° to 266° F. (105° to 130° C.), such that heavy oils and tars condense, as the effluent enters a primary separation vessel. The condensed oils and tars are separated from the gaseous effluent in the primary separation vessel and the remaining gaseous effluent is passed to a quench tower where the temperature of the effluent is reduced to a level at which the effluent is chemically stable.

EP 205 205 proposes a method for cooling a fluid such as a cracked reaction product by using transfer line exchangers having two or more separate heat exchanging sections.

U.S. Pat. No. 5,294,347 proposes that in ethylene manufacturing plants, a water quench column cools gas leaving a primary fractionator and that in many plants, a primary fractionator is not used and the feed to the water quench column is directly from a transfer line exchanger.

JP 2001-40366 proposes cooling mixed gas in a high temperature range with a horizontal heat exchanger and then with a vertical heat exchanger having its heat exchange planes installed in the vertical direction. A heavy component condensed in the vertical exchanger is thereafter separated by distillation at downstream refining steps.

WO 00/56841; GB 1,390,382; GB 1,309,309; and U.S. Pat. Nos. 4,444,697; 4,446,003; 4,121,908; 4,150,716; 4,233,137; 3,923,921; 3,907,661; and 3,959,420; propose various apparatus for quenching a hot cracked gaseous stream wherein the hot gaseous stream is passed through a quench pipe or quench tube wherein a liquid coolant (quench oil) is injected.

SUMMARY OF THE INVENTION

In one aspect, the present invention is directed to a method for treating gaseous effluent from a hydrocarbon pyrolysis unit, which comprises: (a).cooling the gaseous effluent at least to a temperature at which tar, formed by reaction among constituents of the effluent, condenses; (b) passing the mixed gaseous and liquid effluent from step (a) through at least one tar knock-out drum, where the condensed tar separates from the gaseous effluent; (c) cooling the gaseous effluent from step (b) to condense a liquid effluent quench oil; (d) passing the mixed gaseous and liquid effluent from step (c) through at least one quench knock-out drum, where the condensed quench oil separates from the gaseous effluent; (e) cooling the gaseous effluent from step (d) to condense a liquid effluent comprising pyrolysis gasoline and water condensed from steam; (f) passing the mixed gaseous and liquid effluent from step (e) to a distillate drum, where the cooled gaseous effluent, liquid pyrolysis gasoline and liquid water are at least partially separated from each other to form a gaseous effluent stream which is directed to a recovery train, a liquid pyrolysis gasoline rich stream and a liquid water rich stream; and (g) passing the liquid pyrolysis gasoline rich stream to a tailing tower which produces an overhead stream rich in pyrolysis gasoline and a bottoms stream rich in gas oil.

Typically, the gaseous effluent is cooled in step (a) to a temperature of less than about 700° F. (371° C.), say, a temperature ranging from about 400° to about 650° F. (204° to 343° C.), e.g., a temperature ranging from about 450° to about 600° F. (232° to 316° C.); and cooled in step (c) to a temperature of less than about 500° F. (260° C.), say, a temperature ranging from about 200° to 450° F. (93° C. to 232° C.), e.g., a temperature ranging from about 250° to about 400° F. (121° to 204° C.); and cooled in step (e) to a temperature of less than about 200° F. (93° C.), say, a temperature ranging from about 50° to about 180° F. (10° to 82° C.), e.g., a temperature ranging from about 80° to about 130° F. (27° to 127° C.).

In one embodiment of this aspect of the present invention, the overhead stream rich in pyrolysis gasoline has an initial boiling point of less than about 300° F. (149° C.) and a final boiling point in excess of about 500° F. (260° C.), e.g., a final boiling point ranging from about 500° to 1000° F. (260° to about 538° C.).

In another embodiment of this aspect of the invention, (a) includes passing the effluent through a primary heat exchanger, typically a transfer line exchanger, which provides steam having a temperature of at least about 500° F. (260° C.), e.g., ranging from about 500° to about 650° F. (260° to 343° C.) and pressure greater than about 3550 kPa (500 psig), e.g., ranging from about 4240 to about 17340 kPa (600 to 2500 psig).

In yet another embodiment of this aspect of the invention, (a) includes passing the effluent from the primary heat exchanger to a secondary heat exchanger, typically a transfer line exchanger.

In still another embodiment of this aspect of the invention, (a) includes maintaining an outlet temperature for said primary heat exchanger above the dew point of its effluent.

In yet still another embodiment, the cooling in step (a) is effected by direct quench of the gaseous effluent with a liquid quench stream. The liquid quench stream can be selected from water and oil, e.g., liquid quench stream comprising condensed quench oil from step (d).

In another embodiment of this aspect of the invention, step (a) comprises directly contacting the gaseous effluent with a quench liquid, say, quench liquid selected from water and oil, e.g., a condensed quench oil from step (d), after passage of the effluent through the primary heat exchanger.

In still another embodiment of this aspect of the invention, step (g) further includes passing only the liquid pyrolysis gasoline rich stream to the tailing tower.

In yet another embodiment of this aspect of the invention, the cooling of step (c) is effected by direct contact heat exchange, e.g., cooling which includes a water quench step.

In still yet another embodiment of this aspect of the invention, the gaseous effluent of step (a) is derived from pyrolysis of a feed heavier than naphtha.

In a further aspect, the present invention is directed to a method for treating gaseous effluent from a hydrocarbon pyrolysis unit, the method comprising: (a) passing the gaseous effluent derived from pyrolysis of a feed heavier than naphtha through at least one primary heat exchanger, thereby cooling the gaseous effluent and generating high pressure steam; (b) passing a mixed gaseous and liquid effluent from step (a) through at least one knock-out drum, where tar, formed by reaction among constituents of the effluent is condensed and separates from the gaseous effluent; (c) cooling the gaseous effluent from step (b) to condense a liquid effluent quench oil; (d) passing the mixed gaseous and liquid effluent from step (c) through at least one quench knock-out drum, where the condensed quench oil separates from the gaseous effluent; (e) cooling the gaseous effluent from step (d) to condense a liquid effluent comprising pyrolysis gasoline and water condensed from steam; (f) passing the mixed gaseous and liquid effluent from step (e) to a distillate drum, where the cooled gaseous effluent, pyrolysis gasoline and water are at least partially separated from each other to form a gaseous effluent stream which is directed to a recovery train, a liquid pyrolysis gasoline rich stream and a liquid water rich stream; and (g) passing the liquid pyrolysis gasoline rich stream to a tailing tower which produces an overhead stream rich in pyrolysis gasoline and a bottoms stream rich in gas oil.

In yet a further aspect, the present invention is directed to a hydrocarbon cracking apparatus comprising: (a) a reactor for pyrolyzing a hydrocarbon feedstock, the reactor having an outlet through which gaseous pyrolysis effluent can exit the reactor; (b) at least one of i) a heat exchanger connected to the reactor outlet and ii) a line for introducing quench oil downstream of the reactor outlet, for cooling the gaseous pyrolysis effluent; (c) at least one tar knock-out drum connected to and downstream of (b) for separating tar from the gaseous effluent; (d) a cooling train connected to and downstream of the at least one knock-out drum for further cooling the gaseous effluent so as to condense a quench oil fraction; (e) at least one quench knock-out drum for receiving a mixed gaseous and liquid effluent from (d), where the condensed quench oil separates from the gaseous effluent; (f) at least one condenser for cooling the gaseous effluent from (e) to condense a liquid effluent comprising pyrolysis gasoline and water condensed from steam; (g) a distillate drum for receiving mixed gaseous and liquid effluent from (f), where the cooled gaseous effluent, pyrolysis gasoline and water are at least partially separated from each other to form a gaseous effluent stream, a liquid pyrolysis gasoline rich stream and a liquid water rich stream; (h) a recovery train which recovers light olefins from the gaseous effluent from (g); and (i) a tailing tower for receiving the liquid pyrolysis gasoline rich stream of (g) which provides an overhead stream rich in pyrolysis gasoline and a bottoms stream rich in gas oil.

In one embodiment of this aspect of the invention, the tailing tower receives only liquid feed.

In still another embodiment, the apparatus comprises a line for introducing quench oil from said quench drum to the process between (b) and (c).

BRIEF DESCRIPTION OF THE DRAWING

FIG. 1 is a schematic flow diagram of a method according to the present invention of treating the gaseous effluent from the liquid cracking of a gas oil feed.

DETAILED DESCRIPTION OF THE EMBODIMENTS

The present invention provides a low cost way of treating the gaseous effluent stream from a hydrocarbon pyrolysis reactor so as to remove and recover heat therefrom and to separate $C_5$+ hydrocarbons, providing separate pyrolysis gasoline and gas oil fractions, as well as the desired $C_2$-$C_4$ olefins in the effluent, without the need for a primary fractionator.

Typically, the effluent used in the method of the invention is produced by pyrolysis of a hydrocarbon feed boiling in a temperature range, say, from about 104° to about 1022° F. (40° to 550° C.), such as light naphtha or gas oil. Preferably, the effluent used in the method of the invention is produced by pyrolysis of a hydrocarbon feed boiling in a temperature range from above about 356° F. (180° C.), such as feeds heavier than naphtha. Such feeds include those boiling in the range from about 200° to about 1000° F. (93° to 538° C.), say, from about 400° to about 950° F. (204° to 510° C.). Typical heavier than naphtha feeds can include heavy condensates, gas oils, hydrocrackates, condensates, crude oils, and/or crude oil fractions, e.g., reduced crude oils. The temperature of the gaseous effluent at the outlet from the pyrolysis reactor is normally in the range of from about 1400° to 1700° F. (760° to 927° C.) and the invention provides a method of cooling the effluent to a temperature at which the desired $C_2$-$C_4$ olefins can be compressed efficiently, generally less than about 212° F. (100° C.), for example less than about 167° F. (75° C.), such as less than about 140° F. (60° C.) and typically from about 68° to about 122° F. (20° to 50° C.).

In particular, the present invention relates to a method for treating the gaseous effluent from the heavy feed cracking unit, which method comprises passing the effluent through at least one primary heat exchanger, which is capable of recovering heat from the effluent down to a temperature where fouling is incipient. If needed, this heat exchanger can be periodically cleaned by steam decoking, steam/air decoking, or mechanical cleaning. Conventional indirect heat exchangers, such as tube-in-tube exchangers or shell and tube exchangers, may be used in this service. The primary heat exchanger cools the process stream to a temperature between about 644° and 1202° F. (340° and about 650° C.), such as about 1100° F. (593° C.), using water as the cooling medium and generates super high pressure steam.

On leaving the primary heat exchanger, the cooled gaseous effluent is still at a temperature above the hydrocarbon dew point (the temperature at which the first drop of liquid condenses) of the effluent. For a typical heavy feed under cracking conditions, the hydrocarbon dew point of the effluent stream ranges from about 700° to about 1200° F. (371° to 649° C.), say, from about 900° to about 1100° F. (482° to 593° C.). Above the hydrocarbon dew point, the fouling tendency is relatively low, i.e., vapor phase fouling is generally not severe, and there is no liquid present that could cause fouling. Tar condenses from such heavy feeds at a temperature ranging from about 400° to about 650° F. (204° to 343° C.), say, from about 450° to about 600° F. (232° to 316° C.).

Conveniently, a secondary heat exchanger also can be provided and is operated such that it includes a heat exchange surface cool enough to condense part of the effluent and generate a liquid hydrocarbon film at the heat exchange surface. The liquid film is generated in situ and, preferably at or below the temperature at which tar is produced, typically at about 374° F. to about 599° F. (190° C. to 315° C.), such as at about 232° C. (450° F.). This is ensured by proper choice of cooling medium and exchanger design. Because the main resistance to heat transfer is between the bulk process stream and the film, the film can be at a significantly lower temperature than the bulk stream. The film effectively keeps the heat exchange surface wetted with fluid material as the bulk stream is cooled, thus preventing fouling. Such a secondary heat exchanger must cool the process stream continuously to the temperature at which tar is produced. If the cooling is stopped before this point, fouling is likely to occur because the process stream would still be in the fouling regime. This secondary heat exchanger is particularly suitable for use with light liquid feeds, such as naphtha.

In an alternate embodiment, the gaseous effluent from the steam cracker furnace is subjected to direct quench, at a point typically between the furnace outlet and the tar knock-out drum. The quench is effected by contacting the effluent with a liquid quench stream, in lieu of, or in addition to the treatment with transfer line exchangers. Where employed in conjunction with at least one heat exchanger, the quench liquid is preferably introduced at a point downstream of the heat exchanger(s). Suitable quench liquids include liquid quench oil, such as those obtained by a downstream quench oil knock-out drum, pyrolysis fuel oil and water, which can be obtained from various suitable sources, e.g., condensed dilution steam.

After passage through the direct quench and/or heat exchanger(s), the cooled effluent is fed to a tar knock-out drum where the condensed tar is separated from the effluent stream. If desired, multiple knock-out drums may be connected in parallel such that individual drums can be taken out of service and cleaned while the plant is operating. The tar removed at this stage of the process typically has an initial boiling point ranging from about 300° to about 600° F. (149° to 316° C.), typically, at least about 392° F. (200° C.).

The effluent entering the tar knock-out drum(s) should be at a sufficiently low temperature, typically at about 375° F. (191° C.) to about 600° F. (316° C.), such as at about 550° F. (288° C.), that the tar separates rapidly in the knock-out drum(s).

After removal of the tar in the tar knock-out drum(s), the gaseous effluent stream is subjected to an additional cooling sequence that includes passing the effluent through one or more cracked gas coolers and then through at least one quench oil knock-out drum. Such a knock-out drum is provided in the cooling sequence downstream of the tar knock-out drums to separate additional oil from the gas stream and can be preferably operated at a temperature above the dew point of water, typically at about 194° F. to about 302° F. (90° to 150° C.), such as at about 250° F. (121° C.), to produce a light oil fraction having an initial boiling point in the range of about 302° F. to about 536° F. (150° to 280° C.). The gaseous effluent from the quench oil knock-out drum(s) is then directed through at least one indirect partial condenser so as to condense the $C_{5+}$ components, e.g., pyrolysis gasoline, as well as water, in the effluent whose temperature is reduced by the condenser to about 38° C. (100° F.). Passing the effluent through at least one indirect partial condenser is conveniently arranged to lower the temperature of the effluent to about 68° to about 122° F. (20° to 50° C.), typically about 100° F. (38° C.). By operating at such a low temperature, as compared with the temperature of about 180° F. (82° C.) normally achieved with a water quench tower, additional light hydrocarbons can condense, thereby reducing the density of the hydrocarbon phase and improving the separation of pyrolysis gasoline from water.

The resulting effluent from the indirect partial condenser (s) comprising a gaseous fraction and liquid fraction is then separated in a distillate drum into a gaseous overhead, an aqueous fraction and a hydrocarbonaceous fraction, e.g., a $C_{5+}$ stream comprising pyrolysis gasoline and steam cracked gas oil. The gaseous overhead is directed to a recovery train for recovering $C_2$ to $C_4$ olefins. The hydrocarbonaceous fraction is directed to a tailing tower and the pyrolysis gasoline fraction is recovered as overhead whilst the steam cracked gas oil fraction is recovered as bottoms.

Typically, the hydrocarbon fraction condensed in the distillate drum tower from the effluent stream has an initial boiling point of less than about 302° F. (150° C.) and a final boiling point in excess of about 400° F. (204° C.), such as of the order of about 850° F. (454° C.). The hydrocarbon fraction is distilled into a lighter fraction, pyrolysis gasoline, and a heavier fraction, steam cracked gas oil. The pyrolysis gasoline fraction typically has a final boiling point of from about 350° to about 500° F. (177° to about 260° C.). The steam cracked gas oil fraction produced by the tailing tower typically has an initial boiling point greater than about 300° F. (149° C.) and a final boiling point in excess of about 500° F. (260° C.), such as of the order of about 800° F. (427° C.).

It will therefore be seen that in the method of the invention, the pyrolysis effluent is cooled to a temperature at which the lower olefins in the effluent can be efficiently compressed without undergoing a fractionation step. Thus the method of the invention obviates the need for a primary fractionator, the most expensive component of the heat removal system of a conventional naphtha cracking unit. As a result, the pyrolysis gasoline fraction contains some heavier components than would not have been present if the entire gaseous effluent had been passed through a primary fractionator. However, these heavier components are removed as a gas oil fraction taken as bottoms from the tailing tower, a simple distillation tower.

The method of the invention achieves several advantages in addition to the reduced capital and operating costs associated with removal of the primary fractionator. The use of at least one primary transfer line heat exchanger maximizes the value of recovered heat. Further, additional useful heat is recovered after the tar is separated out. Tar and coke are removed from the process as early as possible in a dedicated vessel, minimizing fouling and simplifying coke removal from the process. Liquid hydrocarbon inventory is greatly reduced and pumparound pumps are eliminated. Fouling of primary fractionator trays and pumparound exchangers is eliminated. Safety valve relieving rates and associated flaring in the event of a cooling water or power failure may be reduced. The use of indirect partial condensers eliminates the need to use a water quench tower and associated large pumparounds. Moreover, the use of the quench oil knock-out drum by the present invention removes portions of materials such as gas oils which result from steam cracking heavier than naphtha feeds, which are otherwise present in amounts that interfere with effective operation of the distillate drum in separating oil from water.

In one embodiment of the invention, the low level heat removed from the gas effluent in the cracked gas cooler(s) is used to heat deaerator feed water. Typically, demineralized water and steam condensate are heated to about 260° F. (127° C.) using low pressure steam in a deaerator where air is stripped out. To achieve effective stripping, the maximum temperature of the water entering the deaerator is generally limited to about 11° C. to about 28° C. (20° to 50° F.) below the deaerator temperature, depending on the design of the deaerator system. This allows water to be heated to about 210° to about 240° F. (99° to 116° C.) using indirect heat exchange with the cooling cracked gas stream. Cooling water exchangers could be used as needed to supplement cooling of the cracked gas stream. By way of example, in one commercial olefins plant, about 367,200 kg/hr (816 klb/hr) of demineralized water at about 29° C. (84° F.) and about 339,600 kg/hr (849 klb/hr) of steam condensate at about 75° C. (167° F.) are currently heated to about 131° C. (267° F.) using about 108,900 kg/hr (242 klb/hr) of low pressure steam. These streams could potentially be heated to about 240° F. (116° C.) using heat recovered from cracked gas. This would reduce the deaerator steam requirement from about 108,900 kg/hr to about 20,700 (242 klb/hr to 46 klb/hr), for a savings of about 88,200 kg/hr (196 klb/hr) of low pressure steam, and would reduce the cooling tower duty by about 55 MW (189 MBTU/hr)

The invention will now be more particularly described with reference to the examples shown in the accompanying drawings.

Referring to FIG. 1, in the method of an example of the invention, a hydrocarbon feed 100 comprising heavy gas oil and dilution steam 102 is fed to a steam cracking reactor 104 where the hydrocarbon feed is heated to cause thermal decomposition of the feed to produce lower molecular weight hydrocarbons, such as $C_2$-$C_4$ olefins. The pyrolysis process in the steam cracking reactor also produces some tar and steam cracked gas oil.

Gaseous pyrolysis effluent 106 exiting the steam cracking furnace initially passes through at least one primary transfer line heat exchanger 108 which cools the effluent from an inlet temperature ranging from about 1300° to about 1700° F. (704° to 927° C.), say, from about (1400° to 1600° F.), (760° C. to 871° C.) e.g., about 1500° F. (816° C.), to an outlet temperature ranging from about 600° to about 1300° F. (316° to about 704° C.), say, from about 700° to about 1200° F. (371° to 649° C.), e.g., about 1100° F. (593° C.). The primary heat exchanger 108 comprises a steam inlet 110 for introducing preheated boiler feed water having a temperature ranging from about 260° to about 600° F. (127° to 316° C.), say, from about 350° F. to about 550° F. (177° to 288° C.), e.g., about 400° F. (204° C.). Super high pressure steam is taken from steam outlet 112 and has a temperature ranging from about 530° to about 670° F. (277° to 354° C.), say, from about 567° to about 628° F. (297° to 331° C.), e.g., about 600° F. (about 316° C.), and a pressure ranging from about 6310 to about 17340 kPa (900 to 2500 psig), say, from about 8380 to about 13200 kPa (1200 to 1900 psig). On leaving the primary heat exchanger 108 the cooled gaseous effluent 114 is still at a temperature above the hydrocarbon dew point (the temperature at which the first drop of liquid condenses) of the effluent. Above the hydrocarbon dew point, the fouling tendency is relatively low, i.e., vapor phase fouling is generally not severe, and there is no liquid present that could cause fouling.

After leaving the primary heat exchanger 108, the effluent stream 114 is cooled to a temperature between about 500° to 600° F. (260° and about 316° C.), for example about 550° F. (288° C.), such that the tar in the effluent condenses, producing a mixed liquid and vapor stream. This additional cooling may be achieved by means of a conventional water quench through line 116 and/or an oil quench via line 118.

After cooling the gaseous effluent to or slightly below the temperature at which the tar condenses, the mixed liquid and vapor effluent is passed into at least one tar knock-out drum 120 and separated into a tar and coke fraction 122 removed as bottom and a gaseous fraction 124 taken as overhead. The tar knock-out drum can be a simple drum with few internals, or, a high efficiency separator with improvements known to those of skill in the art for improving separation of liquid and vapor, e.g., one or more tangential inlet nozzles and internal baffles. Thereafter, the gaseous fraction passes through one or more cracked gas coolers 126 and 128, where the fraction is cooled to a temperature of about 200° F. to about 450° F. (93° C. to 232° C.), such as about 300° F. (149° C.) by indirect heat transfer. Preferably the fraction is cooled to a temperature slightly above the dew point of water, with the heat recovered to a useful purpose such as preheating boiler feed water, raising medium pressure steam and/or preheating heavy feed. The cooled effluent, containing liquid components in the gas oil and heavy naphtha boiling range, e.g., condensed pyrolysis gasoline, steam cracked gas oil, at least part of which can be directed to a quench oil knock-out drum 130 which separates the effluent into quench oil taken as bottoms 118 (which can be used as quench upstream of the knock-out drum 120) and gaseous effluent 132 containing water vapor, $C_2$ to $C_4$ olefins and higher boiling hydrocarbons.

The gaseous effluent 132 is directed to condensers 134 and 136 which utilize water as a cooling medium introduced via line 138 at a temperature of about 80° F. (27° C.) which exits the downstream condenser at a temperature of about 100° F. (38° C.) as heated stream 140 which is introduced to the upstream condenser from which it is taken as heated stream 142 at a temperature of about 120° F. (49° C.). In the condensers, the stream is cooled to near ambient temperature, most of the steam is condensed, and pyrolysis gasoline is condensed. The cooled stream 144 is directed to distillate drum 146 wherein the condensate separates into a hydrocarbon fraction 148, which is fed to a tailing tower 150, an aqueous fraction 152, which can be fed to a sour water stripper if necessary (not shown), and a gaseous overhead fraction 154, which can be fed directly to a recovery train as is known to those skilled in the art for cooling and condensing of the $C_2$-$C_4$ olefins in the fraction 154. In the tailing tower 150, the hydrocarbon fraction 148 is fractionated into a pyrolysis gasoline fraction 156, typically having a final boiling point ranging from about 400° to about 450° F. (204° to 232° C.) and a steam cracked gas oil fraction 158, typically having a final boiling point ranging from about 500° to 1000° F. (260° to about 538° C.). The tailing tower distills liquids as is normally done in a primary fractionator, but in a much smaller tower. The pyrolysis gasoline stream thus produced can be suitable for feeding a hydrofiner whilst the bottoms steam cracked gas oil is typically suited for use as a solvent, quench liquid, tar blendstock, or fuel blendstock.

The present invention requires less hardware than a conventional primary fractionator, thereby reducing costs. The primary fractionator is replaced with two knock-out drums and a much smaller fractionation tower. Oil and quench pumparounds associated with a primary fractionator are also eliminated, including their large pumps and drivers along with their associated power requirements. Heat exchangers used in the present invention are substantially comparable in size and load to those employed with a primary fractionator. The present invention dispenses with the additional temperature approach required where a primary fractionator is used. With a primary fractionator, heat removed from the furnace effluent must be exchanged twice, first from the effluent to the pumparound liquid and then from the pumparound liquid to an external service. This requires investment in two heat exchange systems and makes it difficult to recover the heat efficiently because there are two temperature approaches. Pumparounds require large pumps and large heat exchangers to be able to recover the heat at as high a temperature as possible. Therefore, the present invention permits recovery of heat at a higher temperature, thus improving energy efficiency. Finally, inasmuch as no trays or packing are required by the heat recovery train of the present invention, susceptibility to fouling is greatly reduced.

While the invention has been described in connection with certain preferred embodiments so that aspects thereof may be more fully understood and appreciated, it is not intended to limit the invention to these particular embodiments. On the contrary, it is intended to cover all alternatives, modifications and equivalents as may be included within the scope of the invention as defined by the appended claims.

What is claimed is:

1. A method for treating gaseous effluent from a hydrocarbon pyrolysis unit, the method comprising:

(a) cooling the gaseous effluent at least to a temperature at which tar, formed by reaction among constituents of the effluent, condenses;

(b) passing the mixed gaseous and liquid effluent from step (a) through at least one tar knock-out drum, where the condensed tar separates from the gaseous effluent;

(c) cooling the gaseous effluent from step (b) to condense a liquid effluent quench oil;

(d) passing the mixed gaseous and liquid effluent from step (c) through at least one quench knock-out drum, where the condensed quench oil separates from the gaseous effluent;

(e) cooling the gaseous effluent from step (d) to condense a liquid effluent comprising pyrolysis gasoline and water condensed from steam;

(f) passing the mixed gaseous and liquid effluent from step (e) to a distillate drum, where the cooled gaseous effluent, liquid pyrolysis gasoline and liquid water are at least partially separated from each other to form a gaseous effluent stream which is directed to a recovery train, a liquid pyrolysis gasoline rich stream and a liquid water rich stream; and (g) passing the liquid pyrolysis gasoline rich stream to a tailing tower which produces an overhead stream rich in pyrolysis gasoline and a bottoms stream rich in gas oil;

and further, wherein the gaseous effluent from the hydrocarbon pyrolysis unit is cooled without a primary fractionator.

2. The method of claim 1, wherein the gaseous effluent is cooled in step (a) to a temperature of less than about 700° F. (371° C.), cooled in step (c) to a temperature of less than about 500° F. (260° C.), and cooled in step (e) to a temperature of less than about 200° F. (93° C.).

3. The method of claim 1, wherein the gaseous effluent is cooled in step (a) to a temperature ranging from about 400° F. to about 650° F. (204° C. to 343° C.); cooled in step (c) to a temperature ranging from about 200° F. to about 450° F.(121° C. to 204° C.); and cooled in step (e) to a temperature ranging from about 50° F. to about 180° F. (10° C. to 82° C.).

4. The method of claim 1, wherein the gaseous effluent is cooled in step (a) to a temperature ranging from about 450° F. to about 600° F. (232° C. to 316° C.); cooled in step (c) to a temperature ranging from about 250° F. to about 400° F.(121° C. to 204° C.); and cooled in step (e) to a temperature ranging from about 80° F. to about 130° F. (27° C. to 127° C.).

5. The method of claim 1, wherein said overhead stream rich in pyrolysis gasoline has an initial boiling point of less than about 300° F. (149° C.) and a final boiling point in excess of about 500° F. (260° C.).

6. The method of claim 5, wherein said overhead stream rich in pyrolysis gasoline has a final boiling point ranging from about 500° to about 1000° F. (260° to 538° C.).

7. The method of claim 1, wherein step (a) includes passing the effluent through a primary heat exchanger which provides steam having a temperature of at least about 500° F. (260° C.) and pressure greater than about 3550 kPa (500 psig).

8. The method of claim 7, wherein step (a) includes passing the effluent through a primary heat exchanger which provides steam having a temperature ranging from about 500° F. to 650° F. (260° C. to 343° C.) and pressure ranging from about 4240 to about 17340 kPa (600 to 2500 psig).

9. The method of claim 7, wherein step (a) includes passing the effluent from the primary heat exchanger to a secondary heat exchanger.

10. The method of claim 8, wherein step (a) includes maintaining an outlet temperature for said primary heat exchanger above the dew point of its effluent.

11. The method of claim 1, wherein step (a) is effected by direct quench of the gaseous effluent with a liquid quench stream.

12. The method of claim 11, wherein said liquid quench stream is selected from water and oil.

13. The method of claim 12, wherein said liquid quench stream comprises condensed quench oil from step (d).

14. The method of claim 8, wherein step (a) comprises directly contacting the gaseous effluent with a quench liquid after passage of the effluent through said primary heat exchanger.

15. The method of claim 14, wherein said quench liquid is selected from water and oil.

16. The method of claim 15, wherein said quench liquid is condensed quench oil from step (d).

17. The method of claim 1, wherein step (g) further includes passing only the liquid pyrolysis gasoline rich stream to said tailing tower.

18. The method of claim 1, wherein the cooling step (c) is effected by indirect contact heat exchange.

19. The method of claim 1, wherein the cooling step (c) includes a water quench step.

20. The method of claim 1, wherein the gaseous effluent of step (a) is derived from pyrolysis of a feed heavier than naphtha.

21. A method for treating gaseous effluent from a hydrocarbon pyrolysis unit, the method comprising:

(a) passing the gaseous effluent derived from pyrolysis of a feed heavier than naphtha through at least one primary heat exchanger, thereby cooling the gaseous effluent;

(b) passing a mixed gaseous and liquid effluent from step (a) through at least one knock-out drum, where tar, formed by reaction among constituents of the effluent is condensed and separates from the gaseous effluent;

(c) cooling the gaseous effluent from step (b) to condense a liquid effluent quench oil;

(d) passing the mixed gaseous and liquid effluent from step (c) through at least one quench knock-out drum, where the condensed quench oil separates from the gaseous effluent;

(e) cooling the gaseous effluent from step (d) to condense a liquid effluent comprising pyrolysis gasoline and water condensed from steam;

(f) passing the mixed gaseous and liquid effluent from step (e) to a distillate drum, where the cooled gaseous effluent, pyrolysis gasoline and water are at least partially separated from each other to form a gaseous effluent stream which is directed to a recovery train, a liquid pyrolysis gasoline rich stream and a liquid water rich stream; and (g) passing the liquid pyrolysis gasoline rich stream to a tailing tower which produces an overhead stream rich in pyrolysis gasoline and a bottoms stream rich in gas oil;

and further, wherein the gaseous effluent from the hydrocarbon pyrolysis unit is cooled without a primary fractionator.

22. A hydrocarbon cracking apparatus comprising:

(a) a reactor for pyrolyzing a hydrocarbon feedstock, the reactor having an outlet through which gaseous pyrolysis effluent can exit the reactor;

(b) at least one of i) a transfer line heat exchanger connected to the reactor outlet and ii) a line for introducing quench oil downstream of the reactor outlet, for cooling the gaseous pyrolysis effluent;

(c) at least one tar knock-out drum connected to and downstream of (b) for separating tar from the gaseous effluent;

(d) a cooling train connected to and downstream of the at least one knock-out drum for further cooling the gaseous effluent so as to condense a quench oil fraction;

(e) at least one quench oil knock-out drum for receiving a mixed gaseous and liquid effluent from (d), where the condensed quench oil separates from the gaseous effluent;

(f) at least one condenser for cooling the gaseous effluent from (e) to condense a liquid effluent comprising pyrolysis gasoline and water condensed from steam;

(g) a distillate drum for receiving mixed gaseous and liquid effluent from (f), where the cooled gaseous effluent, pyrolysis gasoline and water are at least partially separated from each other to form a gaseous effluent stream, a liquid pyrolysis gasoline rich stream and a liquid water rich stream;

(h) a recovery train which recovers light olefins from the gaseous effluent from (g); and (i) a tailing tower for receiving the liquid pyrolysis gasoline rich stream of (g) which provides an overhead stream rich in pyrolysis gasoline and a bottoms stream rich in gas oil;

and further, said hydrocarbon cracking apparatus being without a primary fractionator.

23. The apparatus of claim 22, wherein said tailing tower receives only liquid feed.

24. The apparatus of claim 22, which further comprises a line for introducing quench oil from said quench drum between (b) and (c).

* * * * *